United States Patent [19]

Jomha et al.

[11] Patent Number: 4,945,578

[45] Date of Patent: Aug. 7, 1990

[54] TOILET FLUSH CONTROL DEVICE

[76] Inventors: Mohamed A. Jomha, 8815 - 163 Street, Edmonton, Alberta, Canada; Andrew Lazowski, deceased, late of Edmonton, Alberta, Canada, T5A 2Y1; by Greg C. Empson, administrator, #1800 Sun Life Place 10123 - 99th Street, Edmonton, Alberta, Canada; by Jose Vieira, administrator, 137 Homestead Crescent, Edmonton, Alberta, Canada, T5A 2Y1

[21] Appl. No.: 164,853

[22] Filed: Mar. 7, 1988

[51] Int. Cl.[5] ..... E03D 1/33

[52] U.S. Cl. ..... 4/391; 4/381; 4/385; 4/324; 4/415

[58] Field of Search ..... 4/328, 379, 381, 382, 4/385, 386, 388, 391, 394, 402, 414, 415, 324

[56] References Cited

U.S. PATENT DOCUMENTS

| | | | |
|---|---|---|---|
| 4,032,997 | 7/1977 | Phripp et al. | 4/415 |
| 4,091,474 | 5/1978 | Makhobey | 4/324 X |
| 4,216,555 | 8/1980 | Detjen | 4/415 |
| 4,224,703 | 9/1980 | Makhobey | 4/324 |
| 4,651,359 | 3/1987 | Battle | 4/381 |

FOREIGN PATENT DOCUMENTS

| | | | |
|---|---|---|---|
| 2735081 | 2/1979 | Fed. Rep. of Germany | 4/385 |
| 10863 | of 1885 | United Kingdom | 4/381 |

*Primary Examiner*—Stephen Marcus
*Assistant Examiner*—Christine A. Peterson
*Attorney, Agent, or Firm*—William R. Hinds

[57] ABSTRACT

A flush control device for use in a toilet tank of the type containing a standpipe and a flap valve pivotally mounted on the standpipe for closing an outlet in the bottom of the tank includes a cylindrical sleeve for slidable mounting on the standpipe and a bulbous float at the bottom of the sleeve. The float is defined by an upwardly opening first cup integral with the bottom end of the sleeve, and an inverted second cup slidably mounted on the sleeve, so that the buoyancy of the device can be changed. Thus, the water level at which the flap valve closes, and consequently the quantity of water discharged through the outlet can be controlled.

4 Claims, 2 Drawing Sheets

TOILET FLUSH CONTROL DEVICE

BACKGROUND OF THE INVENTION

This invention relates to a device for use in a flush toilet, and in particular to a flush control device for use in a toilet tank.

The purpose of flush control devices is to control the amount of water discharged from a toilet tank during each flushing operation. Obvously, there are circumstances where it is advantageous to control the amount of water dispensed to the toilet bowl during each flushing operation even if only to conserve water. Flush control devices are described, for example in Canadian Patents Nos. 1,035,102 and 1,074,056 both of which issued to Clarence F. Fripp et al on July 25, 1978 and Mar. 25, 1980, respectively. The devices disclosed by the Fripp et al patents are somewhat complicated, and consequently would be expensive to manufacture and install.

The object of the present invention is to overcome the disadvantaes of the above-mentioned devices by providing a flush control device for use in a toilet tank which is relatively simple in terms of structure, installation and operation.

BRIEF SUMMARY OF THE INVENTION

Accordingly, the present invention relates to a flush control device for a toilet tank of the type containing a standpipe and a flap valve pivotal on the standpipe for closing an outlet in the bottom of the tank, the outlet being connected to the toilet bowl; said device comprising adjustable buoyancy float means for movement on said standpipe between a valve closing position against the flap valve and a position in which the valve is open and clear of said float means, the buoyancy of said float means, and hence whether it floats higher or lower in the water, determining the water level at which the flap valve closes said outlet, whereby the quantity of water discharged through said outlet can be controlled, said float means comprising sleeve means for slidable mounting on the standpipe, and annular body means on said sleeve means for altering the effective buoyancy of the float means and hence the level at which the float means floats in the water, said body means including a bottom portion fixedly mounted on said sleeve means and a top portion slidably mounted on said sleeve means toward and away from said body portion, said bottom and top portions being substantially cup-shaped, the top cup-shaped portion opening downwardly and the bottom cup-shaped portion opening upwardly, the two cup-shaped portions including matable surfaces such that the two cup-shaped portions can be closed together to form a closed hollow flotation chamber of maximum buoyancy, and moved apart to form a less buoyant body wherein the bottom, upwardly opening, cup-shaped portion is filled with water and the float means floats lower in the water as the separation between said cup-shaped portions is increased.

DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT

Figure 1:
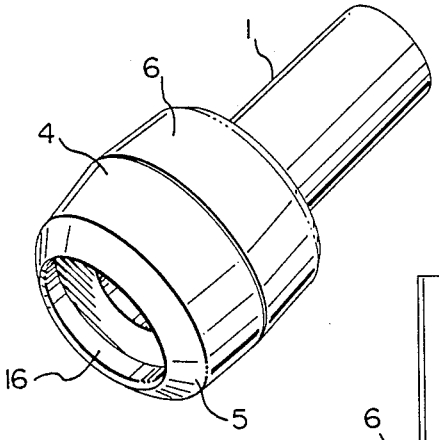
FIG. 1 is a perspective view from one side and below of a flush control device in accordance with the present invention.
Figure 2:
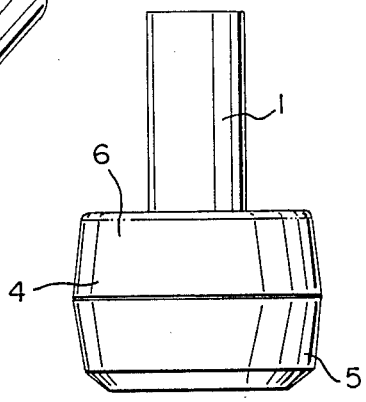
FIG. 2 is a side elevation view of the device of FIG. 1.
Figure 3:
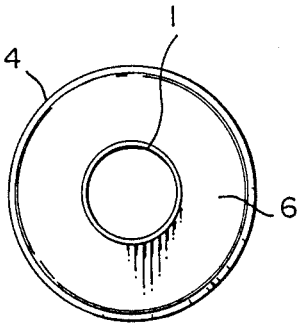
FIG. 3 is a plan view of the device of FIGS. 1 and 2.
Figure 4:
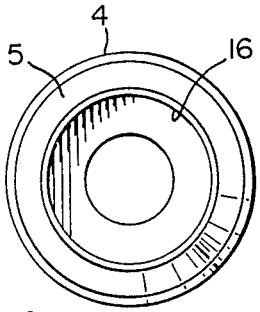
FIG. 4 is a bottom view of the device of FIGS. 1 to 3.
Figure 5:
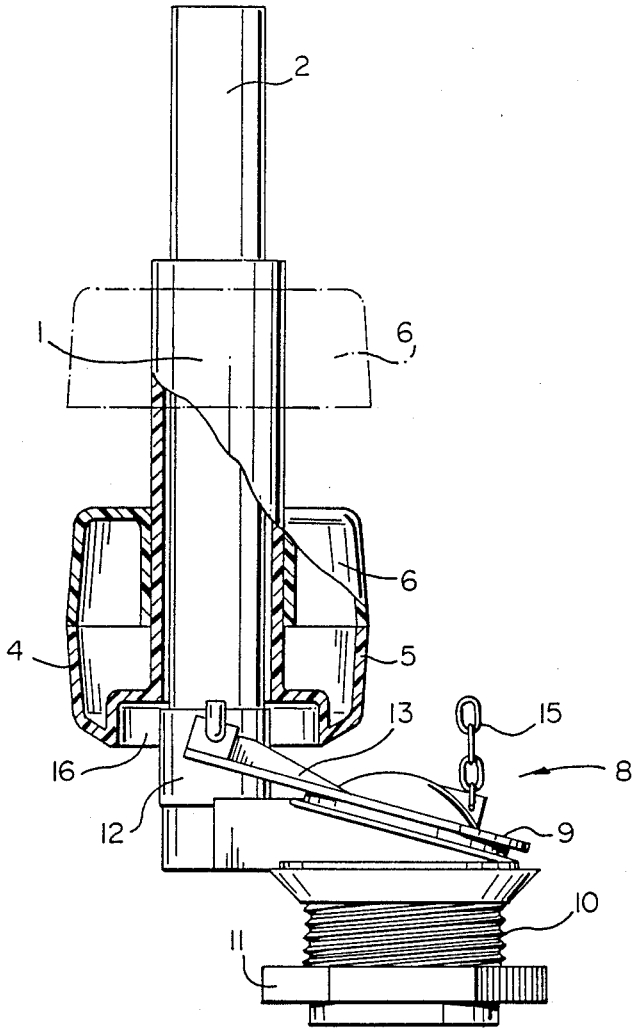
FIG. 5 is a cross sectional view of the device of FIGS. 1 to 4 in the use position.

With reference to FIGS. 1 to 4, the flush control device of the present invention includes an elongated plastic sleeve 1 for slidable mounting on a standpipe 2 (FIG. 5) in a toilet tank. The sleeve 1 forms a part of a float, which is completed by a generally cylindrical hollow body 4. An annular cup 5 is provided on the bottom end of the sleeve 1, the cup 5 being integral with such bottom end of the sleeve. A separate inverted, annular cup 6 is slidably mounted on the sleeve 1 for movement between a lower closed position (FIGS. 1 and 2) and an upper open position, which is shown in phantom outline in FIG. 5. There is a tight friction fit between the cup 6 and the sleeve 1. By grasping the cup 6 and twisting, the cup 6 can be moved along the sleeve 1. In the closed position, the cups 5 and 6 define a closed flotation chamber of maximum buoyancy. The most pronounced change in buoyancy occurs when the body 4 is opened. Once the body opens, water enters both the bottom cup 5 and part of the top cup 6. As the cup 6 is moved upwardly along the sleeve 1, the centre of gravity of the device moves upwardly, and the effective buoyancy of the device decreases in that the device floats lower in the water.

The device of FIGS. 1 to 4 is intended for use in a toilet tank containing the standpipe 2, which pivotally supports a conventional flap valve generally indicated at 8. The flap valve 8 includes a head 9 for seating over an opening into an outlet duct 10 in the bottom of the tank. The duct 10 is threaded for receiving a nut 11 for mounting the duct 10 is an opening (not shown) in the base of a toilet tank. The head 9 of the valve is pivotally connected to a sleeve 12 on the standpipe 2 by an arm 13. The valve 8 is caused to move from the closed position (FIG. 5) to the open position (not shown) by a chain 15 connected to the conventional flush control lever (not shown). A recess 16 is provided in the bottom end of the cup 5 of the float 4, so that the float 4 can move downwardly on the pipe 2 to bear against the arm 13 of the valve 8.

The flush control device of the present invention can be mounted in new or existing toilet tanks. It will be appreciated that the device is easy to install, since it is merely necessary to slide the device downwardly onto the standpipe 2. When the top and bottom portions or cups 5 and 6 of the float 4 are abutting (FIG. 5), the buoyancy of the device is at a maximum. When the toilet is flushed, the device will float on the surface of the water, and thus will not move against the valve 8 until the tank has been more or less completely emptied. In other words, with the cups 5 and 6 abutting, each flushing action of the toilet will be full, i.e. most of the water in the tank will be discharged through the flap valve 8. If the opposing cups 5 and 6 are separated a short distance, water partially entering the inverted cup 6 will define with the cup or air pocket which will impede downward movement of the device, but not to the same extent as the closed float 4. Thus, with the cups 5 and 6 separated, the bottom of the float 4 will engage the valve 8 to close the latter before all of the water has been discharged from the toilet tank. The greater the separation between the cups 5 and 6, the sooner the bottom cup will strike the arm 13 of the valve 8. Actually, with the cups 5 and 6 separated, the buoyancy of the device does not change substantially as the cup 6 is moved a greater distance away from the cup 5. However, because the cup 6 is supported at water level, the greater the separation between the cups, the sooner the cup 5 abuts the valve 8 as water is being discharged through the outlet duct 10. By changing the separation between the cups 5 and 6, more or less water can be discharged from the toilet tank.

Thus, there has been described a relatively simple flush control device, which is easy to install and to operate.

What is claimed is:

1. A flush control device for a toilet tank of the type containing a standpipe and a flap valve pivotal on the standpipe for closing an outlet in the bottom of the tank, the outlet being connected to the toilet bowl; said device comprising adjustable buoyancy float means for movement on said standpipe between a valve closing position against the flap valve and a position in which the valve is open and clear of said float means, the buoyancy of said float means, and hence whether it floats higher or lower in the water, determining the water level at which the flap valve closes said outlet, whereby the quantity of water discharged through said outlet can be controlled, said float means comprising sleeve means for slidable mounting on the standpipe, and annular body means on said sleeve means for altering the effective buoyancy of the float means and hence the level at which the float means floats in the water, said body means including a bottom portion fixedly mounted on said sleeve means and a top portion slidably mounted on said sleeve means toward and away from said body portion, said bottom and top portions being substantially cup-shaped, the top cup-shaped portion opening downwardly and the bottom cup-shaped portion opening upwardly, the two cup-shaped portions including matable surfaces such that the two cup-shaped portions can be closed together to form a closed hollow flotation chamber of maximum buoyancy, and moved apart to form a less buoyant body wherein the bottom, upwardly opening, cup-shaped portion is filled with water and the float means floats lower in the water as the separation between said cup-shaped portions is increased.

2. A device as claimed in claim 1 wherein said sleeve means extends upwardly completely through and beyond said top cup-shaped portion such that the top and bottom cup-shaped portions can be completely separated by movement of said top cup-shaped portion along said sleeve.

3. A device as claimed in claim 2 wherein said bottom cup-shaped portion is formed with an upwardly extending central recess in its bottom surface boundaried by a downwardly depending peripheral wall such that said recess facilitates downward movement of the float means on the standpipe and actuating contact of the peripheral wall with a member connected with said flap valve to close the flap valve at a water level dependent on the degree of separation between said top and bottom cup-shaped portions.

4. A device according to claim 1, wherein said bottom portion of said body means is integral with said sleeve means.

* * * * *